US010237673B2

(12) United States Patent
Beack et al.

(10) Patent No.: US 10,237,673 B2
(45) Date of Patent: *Mar. 19, 2019

(54) AUDIO ENCODING APPARATUS AND METHOD, AUDIO DECODING APPARATUS AND METHOD, AND AUDIO REPRODUCING APPARATUS

(71) Applicant: Electronics and Telecommunications Research Institute, Daejeon (KR)

(72) Inventors: Seung Kwon Beack, Seoul (KR); Tae Jin Lee, Daejeon (KR); Jong Mo Sung, Daejeon (KR); Kyeong Ok Kang, Daejeon (KR); Jeong Il Seo, Daejeon (KR); Dae Young Jang, Daejeon (KR); Yong Ju Lee, Daejeon (KR); Jin Woong Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/871,669

(22) Filed: Jan. 15, 2018

(65) Prior Publication Data

US 2018/0139556 A1 May 17, 2018

Related U.S. Application Data

(63) Continuation of application No. 14/477,498, filed on Sep. 4, 2014, now Pat. No. 9,906,883.

(30) Foreign Application Priority Data

Sep. 5, 2013 (KR) ..... 10-2013-0106861

(51) Int. Cl.
*H04S 3/00* (2006.01)
*G10L 19/008* (2013.01)

(52) U.S. Cl.
CPC ..... *H04S 3/008* (2013.01); *G10L 19/008* (2013.01); *H04S 2420/03* (2013.01)

(58) Field of Classification Search
None
See application file for complete search history.

(56) References Cited

U.S. PATENT DOCUMENTS 8,364,497 B2 * 1/2013 Beack ..... G10L 19/008 381/2
8,370,164 B2 * 2/2013 Beack ..... H04S 7/30 381/119

(Continued)

OTHER PUBLICATIONS

Next Generation Audio for Cinema, Dolby Laboratories, Inc. San Francisco, CA.

*Primary Examiner* — Pierre Louis Desir
*Assistant Examiner* — Jonathan C Kim
(74) *Attorney, Agent, or Firm* — William Park & Associates Ltd.

(57) ABSTRACT

An audio encoding apparatus and method that encodes hybrid contents including an object sound, a background sound, and metadata, and an audio decoding apparatus and method that decodes the encoded hybrid contents are provided. The audio encoding apparatus may include a mixing unit to generate an intermediate channel signal by mixing a background sound and an object sound, a matrix information encoding unit to encode matrix information used for the mixing, an audio encoding unit to encode the intermediate channel signal, and a metadata encoding unit to encode metadata including control information of the object sound.

8 Claims, 6 Drawing Sheets

(56) References Cited

U.S. PATENT DOCUMENTS

2008/0192941 A1* 8/2008 Oh ..... G10L 19/008 704/E19.005
2009/0055196 A1* 2/2009 Oh ..... G10L 19/008 704/500
2009/0144063 A1* 6/2009 Beack ..... G10L 19/008 704/500
2009/0210238 A1* 8/2009 Kim ..... G10L 19/008 704/500
2009/0210239 A1* 8/2009 Yoon ..... G10L 19/008 704/500
2010/0087938 A1* 4/2010 Oh ..... G10L 19/008 700/94
2010/0094631 A1* 4/2010 Engdegard ..... G10L 19/008 704/258
2010/0114582 A1* 5/2010 Beack ..... H04S 7/30 704/500
2010/0121647 A1* 5/2010 Beack ..... G10L 19/008 704/500
2010/0174548 A1* 7/2010 Beack ..... G10L 19/008 704/503
2010/0284551 A1* 11/2010 Oh ..... G10L 19/008 381/119
2010/0324915 A1* 12/2010 Seo ..... G10L 19/008 704/500
2011/0015770 A1* 1/2011 Seo ..... G10L 19/008 700/94
2011/0022402 A1* 1/2011 Engdegard ..... G10L 19/20 704/501
2011/0112842 A1* 5/2011 Seo ..... G10L 19/008 704/500
2011/0166867 A1* 7/2011 Seo ..... G10L 19/20 704/500
2012/0057715 A1* 3/2012 Johnston ..... G10L 19/008 381/63
2012/0078642 A1* 3/2012 Seo ..... G10L 19/008 704/500
2012/0259643 A1 10/2012 Engdegard et al.
2013/0170646 A1* 7/2013 Yoo ..... G10L 19/008 381/2
2014/0372130 A1* 12/2014 Yoo ..... G10L 19/008 704/500
2015/0221314 A1* 8/2015 Disch ..... G10L 19/025 704/500
2015/0279376 A1* 10/2015 Beack ..... G10L 19/008 381/23
2015/0356976 A1* 12/2015 Herre ..... G10L 19/008 704/500
2015/0356977 A1* 12/2015 Herre ..... G10L 19/008 704/500
2016/0111099 A1* 4/2016 Hirvonen ..... G10L 19/20 381/22

* cited by examiner

AUDIO ENCODING APPARATUS AND METHOD, AUDIO DECODING APPARATUS AND METHOD, AND AUDIO REPRODUCING APPARATUS

CROSS-REFERENCE TO RELATED APPLICATION

The present application is a continuation application of U.S. application Ser. No. 14/477,498, filed on Sep. 4, 2014, and claims priority under 35 U.S.C. § 119(a) to Korean Patent Application No. 10-2013-0106861, filed on Sep. 5, 2013, in the Korean Intellectual Property Office, the disclosure of which is incorporated herein by reference.

BACKGROUND

1. Field of the Invention

A following description relates to an audio encoding apparatus that encodes audio signals such as a background sound and an object sound, an audio decoding apparatus that decodes the encoded audio signals, and an audio reproducing apparatus that reproduces the audio signals.

2. Description of the Related Art

Recently, Dolby introduced Atmos which is a theater sound format technology. Different from a conventional theater sound format includes signals a 5.1 channel or a 7.1 channel, Atmos includes audio channel signals forming a background sound and controllable audio channel signals.

Atmos defines the audio channel signals forming the background sound to be Beds, and the controllable audio channel signals to be Object. Beds refers to general audio channel signals, that is, an audio content that may form an audio scene excluding an audio object. Object refers to a main audio content of the audio scene formed by Beds, that is, an audio content included in the audio scene through control of the audio signals.

Control information related to control of Object is expressed by Metadata. Atmos includes a package of Beds, Objects, and Metadata, through which a final channel signal is generated.

SUMMARY

According to an aspect of the present invention, there is provided an audio encoding apparatus including a mixing unit to generate an intermediate channel signal by mixing a background sound and an object sound, a matrix information encoding unit to encode matrix information used for the mixing, an audio encoding unit to encode the intermediate channel signal, and a metadata encoding unit to encode metadata including control information of the object sound.

The audio decoding unit may include a first encoder to encode the intermediate channel signal and generate a bitstream, and a second encoder to encode the object sound or the background sound to be used for unmixing of the intermediate channel signal.

According to another aspect of the present invention, there is provided an audio decoding apparatus including an audio decoding unit to decode an encoded intermediate channel signal included in a bitstream, an unmixing unit to unmix the decoded intermediate channel signal and output an object sound and a background sound, a matrix information decoding unit to decode matrix information used for the unmixing, and a metadata decoding unit to decode metadata including control information of the object sound.

The audio decoding unit may include a first decoder to decode the bitstream and output the intermediate channel signal, and a second decoder to decode the object sound or the background sound to be used for unmixing.

According to another aspect of the present invention, there is provided an audio reproducing apparatus including a decoding unit to decode an encoded intermediate channel signal included in a bitstream and output an object sound and a background sound by unmixing the decoded intermediate channel signal, a metadata determination unit to determine metadata to be used for rendering based on audio reproduction environment information, and a rendering unit to render the object sound and the background sound based on the metadata.

According to another aspect of the present invention, there is provided an audio encoding method including generating an intermediate channel signal by mixing a background sound and an object sound, encoding matrix information used for the mixing, and encoding the intermediate channel signal and metadata including control information of the object sound, and encoding the object sound and the background sound to be used for unmixing of the intermediate channel signal.

According to another aspect of the present invention, there is provided an audio decoding method including decoding an encoded intermediate channel signal included in a bitstream, and an object sound or a background sound to be used for unmixing of the intermediate channel signal, decoding matrix information used for the unmixing, and unmixing the intermediate channel signal using the matrix information and outputting the background sound and the background sound, and decoding metadata including control information of the object sound and outputting the decoded metadata.

The audio encoding method may further include determining metadata to be used for rendering based on audio reproduction environment information, and rendering the background sound and the object sound based on the metadata.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
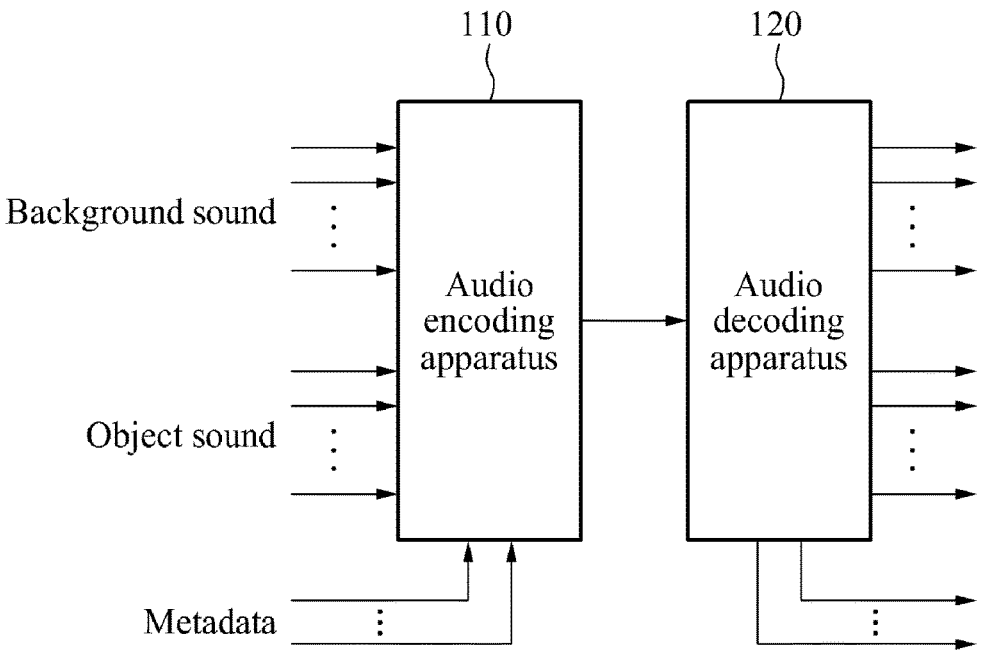
FIG. 1 is a diagram illustrating an operation between an audio encoding apparatus and an audio decoding apparatus, according to an embodiment of the present invention.

Reference will now be made in detail to exemplary embodiments of the present invention, examples of which are illustrated in the accompanying drawings, wherein like reference numerals refer to the like elements throughout. An audio encoding method according to an embodiment of the present invention may be performed by an audio encoding apparatus. An audio decoding method according to an embodiment of the present invention may be performed by an audio decoding apparatus or an audio reproducing apparatus.

FIG. 1 is a diagram illustrating an operation between an audio encoding apparatus 110 and an audio decoding apparatus 120.

The audio encoding apparatus 110 may encode a background sound, an object sound, and metadata. The background sound, the object sound, and the metadata may be hybrid contents constituting a single package. For example, the hybrid contents may include Atmos audio signals of Dolby, and the like.

The background sound may refer to a general audio channel signal, that is, an audio signal forming an audio scene. The object sound refers to a controllable audio signal which is controlled by the metadata. The object sound may form a dynamic audio scene in association with the audio scene formed by the background sound. The metadata may include control information of the object sound. The metadata may be generated by an audio content producer. The metadata may include a plurality of metadata generated in consideration of various audio reproduction environments. For example, the metadata may include metadata for rendering to a layout of a speaker system such as stereo, 5.1 channel, 7.1 channel, and the like. The audio encoding apparatus 110 may encode the plurality of metadata generated in consideration of various audio reproduction environments and transmit the encoded metadata.

Through the encoding and transmission of the hybrid contents, the audio encoding apparatus 110 may increase efficiency in storing and transmitting the hybrid contents. The background sound, the object sound, and the metadata may be encoded and transmitted to the audio decoding apparatus 120. The audio encoding apparatus 110 may mix the background sound and the object sound into an intermediate channel signal and encode the intermediate channel signal. The audio encoding apparatus 110 may encode an object sound or background sound, and matrix information necessary for unmixing of the intermediate channel signal. For example, the encoded metadata and the encoded matrix information may be transmitted to the audio decoding apparatus 120 in the form of a bitstream or an additional information bitstream.

The audio decoding apparatus 120 may decode the intermediate channel signal, the object sound or the background sound necessary for unmixing of the intermediate channel signal, and the metadata. The audio decoding apparatus 120 may extract the object sound or the background sound from the intermediate channel signal based on the object sound or the background sound necessary for unmixing of the intermediate channel signal and the matrix information. The audio decoding apparatus 120 may output the object sound or the background sound extracted from the intermediate channel signal, the decoded object sound or background sound, and the decoded metadata.

Figure 2:
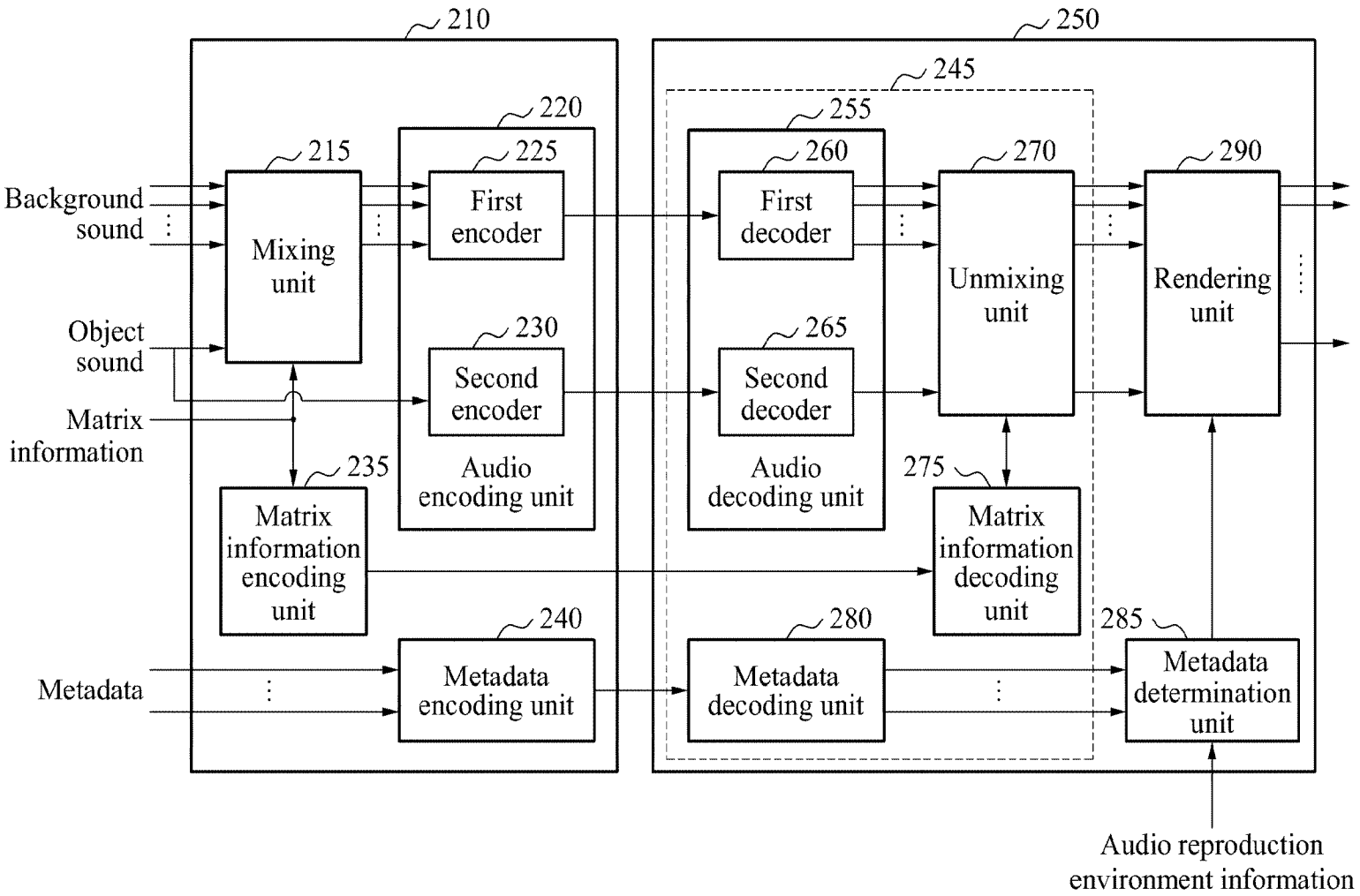
FIG. 2 is a diagram illustrating configurations of an audio encoding apparatus, an audio decoding apparatus, and an audio reproducing apparatus, according to an embodiment of the present invention.

FIG. 2 is a diagram illustrating configurations of an audio encoding apparatus 210, an audio decoding apparatus 245, and an audio reproducing apparatus 250, according to an embodiment of the present invention.

Referring to FIG. 2, the audio encoding apparatus 210 may include a mixing unit 215, an audio encoding unit 220, a matrix information encoding unit 235, and a metadata encoding unit 240.

The mixing unit 215 may generate an intermediate channel signal by mixing a background sound and an object sound. The mixing unit 215 may perform mixing using the matrix information for mixing of the background sound and the object sound. The mixing unit 215 may use matrix information prestored in the audio encoding apparatus 210, or matrix information determined by a content producer or a system designer. The matrix information used for mixing of the background sound and the object sound may be encoded by the matrix information encoding unit 235.

The mixing unit 215 may perform mixing using a rendering matrix with respect to a vector element of the background sound and a rendering matrix with respect to a vector element of the object sound. For example, the mixing unit 215 may perform matrix calculation based on a channel gain of the background sound and a gain of the object sound mixed with the background sound. The intermediate channel signal output by the mixing unit 215 may be determined on the basis of the vector element of the background sound, the vector element of the object sound, the channel gain of the background sound, and the gain of the object sound mixed with the background sound.

The metadata encoding unit 240 may encode metadata including control information with respect to the object sound. The metadata encoding unit 240 may encode a plurality of metadata generated based on various reproduction environments. That is, the metadata encoding unit 240 may encode the plurality of metadata corresponding to different audio reproduction environments. For example, encoded matrix information and encoded metadata may be transmitted in the form of a bitstream or an additional information bitstream. However, not limited to the foregoing examples, the encoded matrix information and the encoded metadata may be transmitted in other forms.

The audio encoding unit 220 may encode an audio signal. The audio encoding unit 220 may include a first encoder 225 to encode the intermediate channel signal output by the mixing unit 215, and a second encoder 330 to encode the object sound or the background sound to be used for unmixing of the intermediate channel signal.

The first encoder 225 may encode the intermediate channel signal and output the encoded intermediate channel signal as a bitstream. The second encoder 230 may encode at least one of the background sound and the object sound. For an unmixing unit 270 of the audio decoding apparatus 245 to extract an original object sound and an original background sound from the intermediate channel signal, the object sound or the background sound need to be input to the unmixing unit 270. The second encoder 230 may encode the background sound or the object sound to be used for unmixing by the unmixing unit 270.

For example, when the object sound is used for unmixing of the intermediate channel signal, the second encoder 230 may encode the object sound and output the encoded object sound as a bitstream. The encoded object sound may be transmitted to a second decoder 265 of the audio decoding apparatus 245. The second decoder 265 may decode the encoded object sound and transmit the object sound to the unmixing unit 270. The unmixing unit 270 may extract the object sound from the intermediate channel signal, using the background sound received from the second decoder 265.

As another example, when the background sound is used for unmixing of the intermediate channel signal, the second encoder 230 may encode the background sound and output the encoded background sound as a bitstream. The encoded background sound may be transmitted to the second decoder 265 of the audio decoding apparatus 245. The second decoder 265 may decode the encoded background sound and transmit the background sound to the unmixing unit 270. The unmixing unit 270 may extract the object sound from the intermediate channel signal, using the background sound received from the second decoder 265.

For convenience of explanation, the embodiment of FIG. 2 presumes that the object sound is used for unmixing of the intermediate channel signal.

Referring to FIG. 2, the audio decoding apparatus 245 may include an audio decoding unit 255, a matrix information decoding unit 275, the unmixing unit 270, and a metadata decoding unit 280.

The audio decoding unit 255 may decode an encoded audio signal included in the bitstream. The audio decoding unit 255 may include a first decoder 260 to decode the bitstream and output the intermediate channel signal, and a second decoder 265 to decode the object sound or the background sound to be used for unmixing of the intermediate channel signal.

The matrix information decoding unit 275 may decode matrix information used for unmixing. The unmixing unit 270 may perform matrix calculation using the decoded matrix information. The matrix information may correspond to the matrix information used for generating the intermediate channel signal by the mixing unit 215 of the audio encoding unit 210.

The unmixing unit 270 may output the object sound or the background sound by unmixing the intermediate channel signal. The unmixing unit 270 may use the decoded object sound or the decoded background sound which are decoded by the second decoder 265 for unmixing. The unmixing unit 270 may extract the object sound or the background sound from the intermediate channel signal, by performing an inverse procedure to the matrix calculation performed by the mixing unit 215.

For example, when receiving the decoded object sound from the second decoder 265, the unmixing unit 270 may extract the background sound from the intermediate channel signal using the decoded object sound, and may output the decoded object sound and the extracted background sound.

As another example, when receiving the decoded background sound from the second decoder 265, the unmixing unit 270 may extract the object sound from the intermediate channel signal using the decoded background sound, and may output the decoded background sound and the extracted object sound.

The metadata decoding unit 280 may decode the encoded metadata. As a result of metadata decoding, a plurality of metadata may be reconstructed.

The audio decoding apparatus 245 may output the hybrid contents by combining the metadata output from the metadata decoding unit 280, and the background sound and the object sound output from the unmixing unit 270. The decoded hybrid contents may be reconstructed into the hybrid contents through decoding and unmixing. A procedure of generating the intermediate channel signal from the background sound and the object sound by the mixing unit 215 and a procedure of converting the intermediate channel signal into the background sound and the object sound by the unmixing unit 270 will be described in detail with reference to FIG. 3.

Referring to FIG. 2, the audio reproducing apparatus 250 may include all component elements of the audio decoding apparatus 245 and may further include a rendering unit 290 and a metadata determination unit 285. The component elements of the audio decoding apparatus 245 included in the audio reproducing apparatus 250 may be referenced from the above description.

The metadata determination unit 285 may determine metadata to be used for rendering, based on audio reproduction environment information among the plurality of metadata reconstructed by the metadata decoding unit 280. The audio reproduction environment information may include information on an audio reproducing system of a user or audio reproduction environment information input by the user. For example, when the audio reproduction environment information represents that the audio reproduction environment is a 5.1 channel, the metadata determination unit 285 may select metadata corresponding to a reproduction environment of the 5.1 channel from the plurality of metadata, and provide the selected metadata to the rendering unit 290.

Since the metadata determination unit 285 determines the metadata to be used for rendering by considering the audio reproduction environment information, the audio reproduction apparatus 250 may flexibly reproduce an output appropriate for a layout of a speaker system.

The rendering unit 290 may render the object sound and the background sound based on the metadata provided by the metadata determination unit 285. The rendering unit 290 may output a target channel signal by rendering the object sound and the background sound. The target channel signal may denote an audio signal expressing an audio scene through combination of the background sound and the object sound. The rendering unit 290 may form the audio scene appropriate for a channel layout of the audio reproduction environment based on the metadata.

Figure 3:
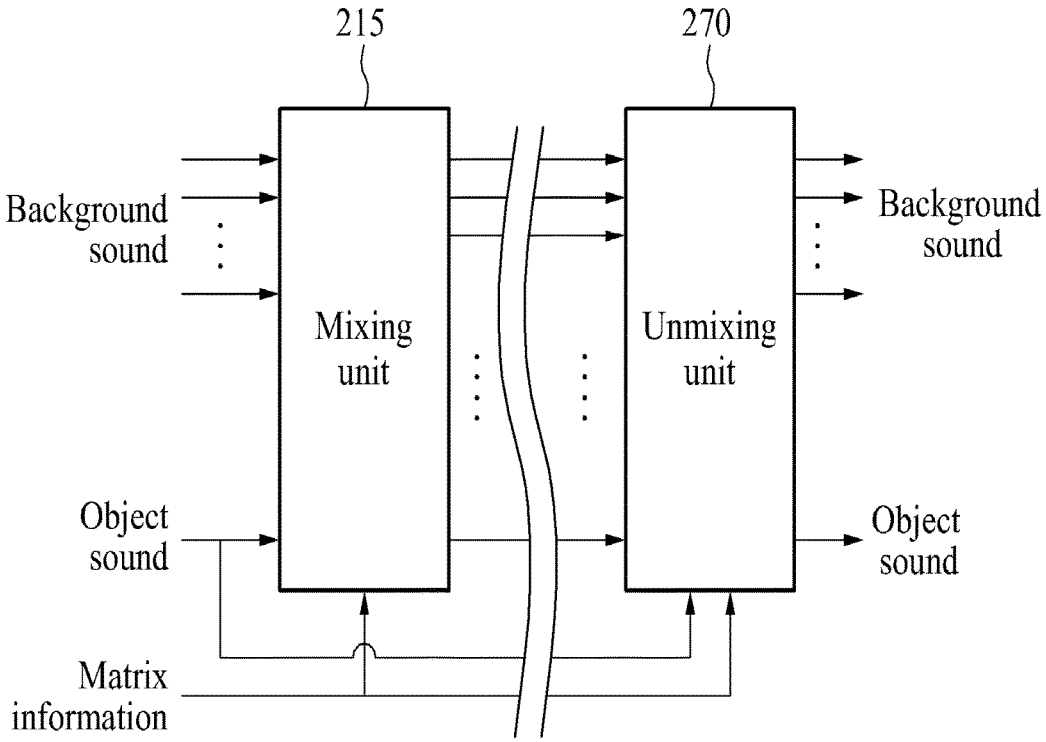
FIG. 3 is a diagram illustrating an operation of a mixing unit and an unmixing unit, according to an embodiment of the present invention.

FIG. 3 is a diagram illustrating an operation of a mixing unit 215 and an unmixing unit 270, according to an embodiment of the present invention.

Hereinafter, a configuration in which the mixing unit 215 generates an intermediate channel signal by mixing of a background sound and an object sound based on matrix information and a configuration in which the unmixing unit 270 outputs the background sound and the object sound by unmixing of the intermediate channel signal based on the matrix information will be described in detail.

In FIG. 3, hybrid contents Xhybird including a background sound Xbeds and an object sound Xobject may be expressed by Equation 1. The background sound and the object sound of the hybrid contents may be input to the mixing unit 215.

$$X_{hybrid}=[X_{beds},X_{object}]^T \quad \text{[Equation 1]}$$

Here, $X_{hybrid}$ denotes an input signal vector of the hybrid contents. $X_{beds}$ denotes a vector string with respect to the background sound. $X_{object}$ denotes a vector string with respect to the object sound.

The vector string $X_{beds}$ with respect to the background sound may be expressed by Equation 2.

$$X_{beds}=[x_{beds,0}(n), \ldots, x_{beds,ch}(n), \ldots, x_{beds,N-1}(n)]^T \quad \text{[Equation 2]}$$

Here, ch denotes a channel index of the background sound, and N denotes a number of channels of the background sound included in the hybrid contents.

The vector string $X_{object}$ with respect to the object sound may be expressed by Equation 3.

$$X_{object}=[x_{object,0}(n), \ldots, x_{object,obj}(n), \ldots, x_{object,M-1}(n)]^T \quad \text{[Equation 3]}$$

Here, obj denotes an index related to a number of objects, and M denotes a number of object sounds included in the hybrid contents. When the hybrid contents are produced, M may generally be set to 1 or 2 although not limited thereto.

The mixing unit may perform mixing based on Equation 4. The mixing may include matrix calculation.

$$y = R \cdot X_{hybrid} = [\, R_{beds} \quad R_{object} \,] \begin{bmatrix} x_{beds} \\ x_{object} \end{bmatrix} \quad \text{[Equation 4]}$$

Here, y denotes an intermediate channel signal generated as a result of the mixing, which may be expressed by Equation 5.

$$y=[y_0(n), \ldots, y_{ch}(n), \ldots, y_{N-1}(n)]^T \quad \text{[Equation 5]}$$

The intermediate channel signal y denotes a column vector equivalent to a dimension of the background sound.

In Equation 4, R denotes a rendering matrix composed of $[R_{beds}\ R_{object}]$ $R_{beds}$ denotes a matrix for performing rendering with respect to $X_{beds}$, and $R_{object}$ denotes a matrix for performing rendering with respect to $X_{object}$.

Matrix components of R may be expressed by Equation 6.

$$R = \left[ \underbrace{\begin{matrix} g_0^{bed}(n) & 0 & \ldots & 0 \\ 0 & g_1^{bed}(n) & & \vdots \\ \vdots & & \ddots & 0 \\ 0 & \ldots & 0 & g_{N-1}^{bed}(n) \end{matrix}}_{R_{beds}} \quad \underbrace{\begin{matrix} g_0^0 e^{j\omega\tau_0^0} \\ g_1^0 e^{j\omega\tau_1^0} \\ \vdots \\ g_{N-1}^0 e^{j\omega\tau_{N-1}^0} \end{matrix}}_{R_{object}} \right] \begin{bmatrix} x_{beds,0}(n) \\ \vdots \\ x_{beds,N-1}(n) \\ x_{object,0}(n) \end{bmatrix} \quad \text{[Equation 6]}$$

In Equation 6, it is presumed that the object sound is single in number, for convenience in explanation. In Equation 6, $g_{ch}^{bed}$ denotes a channel gain with respect to a ch-th channel of the background sound, and $g_{ch}^{obj}$ denotes a gain of the object sound mixed with a ch-th background sound channel signal. Here, ch denotes a positive number between 0 and N−1. N denotes a number of channels of the background sound included in the hybrid contents. Since the object sound is presumed to be single, obj of $g_{ch}^{obj}$ is 0. (0≤obj≤M−1)

$$e^{j\omega\tau_{ch}^{obj}}$$

denotes an element indicating a time delay. A time delay as much as $\tau_{ch}^{obj}$ is applied to the ch-th channel of the background sound and mixing is performed.

The intermediate channel signal y of Equation 5 and Equation 6 may be expressed by Equation 7.

$$y_0 = g_0^{bed}(n)x_{beds,0} + g_0^0(n)e^{j\omega\tau_0^0}x_{object,0}(n) \quad \text{[Equation 7]}$$

-continued $$y_1 = g_1^{bed}(n)x_{beds,1} + g_1^0(n)e^{j\omega\tau_1^0}x_{object,0}(n)$$

$$\vdots$$

$$y_{N-1} = g_{N-1}^{bed}(n)x_{beds,N-1} + g_{N-1}^0(n)e^{j\omega\tau_{N-1}^0}x_{object,0}(n)$$

According to Equation 7, the intermediate channel signal y includes the background sound and the object sound. The intermediate channel signal may be provided directly to the user. In addition, the intermediate channel signal may have a backward compatibility with a conventional audio codec system.

Unmixing is necessary to convert the intermediate channel signal into the hybrid contents including the background sound and the object sound. Matrix information R necessary for the unmixing and object sound information necessary for the unmixing may be decoded and input to the unmixing unit 270. Since the embodiment of FIG. 3 presumes that the object sound information is used for the unmixing, the object sound information is input to the unmixing unit 270.

The unmixing unit 270 may extract components with respect to the background sound from the intermediate channel signal using the matrix information and the object sound information. The unmixing unit 270 may construct the hybrid contents again using the transmitted object sound and the unmixed background sound.

The unmixing of the unmixing unit 270 may be performed based on Equation 8.

[Equation 8]

$$\hat{x}_{beds,0}(n) = (g_0^{bed}(n))^{-1}\left(y_0(n) - g_0^0(n)e^{j\omega\tau_0^0}\hat{x}_{object,0}(n)\right)$$

$$\hat{x}_{beds,1}(n) = (g_1^{bed}(n))^{-1}\left(y_1(n) - g_1^0(n)e^{j\omega\tau_1^0}\hat{x}_{object,0}(n)\right)$$

$$\vdots$$

$$\hat{x}_{beds,N-1}(n) = (g_{N-1}^{bed}(n))^{-1}\left(y_{N-1}(n) - g_{N-1}^0(n)e^{j\omega\tau_{N-1}^0}\hat{x}_{object,0}(n)\right)$$

Since the background sound and the object sound may be changed from their original forms by encoding and decoding, the object sound and the background sound are expressed in a hat form in Equation 8. To perform the unmixing, the unmixing unit 270 may inversely perform the matrix calculation used in mixing. Since a method of generating the intermediate channel signal from the object sound and the background sound can be understood from Equation 7, the matrix calculation related to Equation 8 will not be described in detail.

Figure 4:
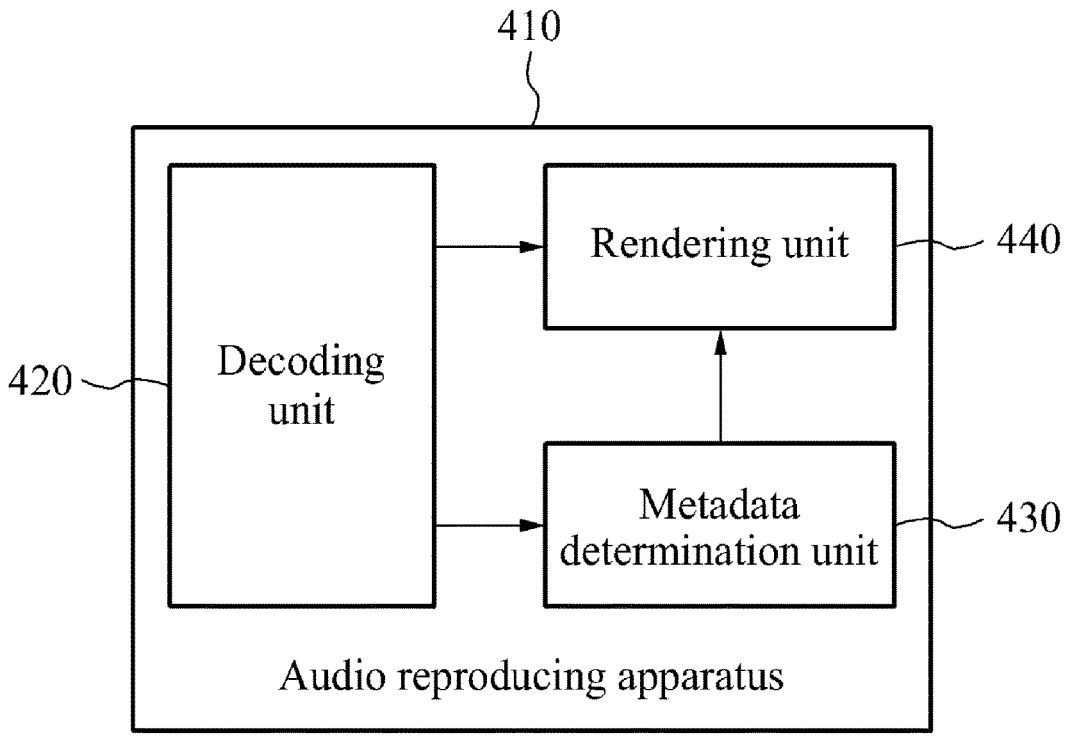
FIG. 4 is a diagram illustrating a configuration of an audio reproducing apparatus, according to an embodiment of the present invention.

FIG. 4 is a diagram illustrating a configuration of an audio reproducing apparatus 410, according to an embodiment of the present invention.

Referring to FIG. 4, the audio reproducing apparatus 410 may include a decoding unit 420, a metadata determination unit 430, and a rendering unit 440.

The decoding unit 420 may decode an encoded intermediate channel signal included in a bitstream and unmix the decoded intermediate channel signal, thereby outputting an object sound and a background sound. The decoding unit 420 may decode matrix information used for the unmixing and may unmix the decoded intermediate channel signal based on the decoded matrix information.

The decoding unit 420 may decode the object sound or the background sound to be used for the unmixing and may extract the object sound or the background sound from the intermediate channel signal using the decoded object sound or the decoded background sound. For example, when the background sound is used for the unmixing, the decoding unit 420 may extract the object sound from the intermediate channel signal using the decoded background sound, and output the decoded background sound and the extracted object sound. As another example, when the object sound is used for the unmixing, the decoding unit 420 may extract the background sound from the intermediate channel signal using the decoded object sound, and output the decoded object sound and the extracted background sound.

The decoding unit 420 may decode a plurality of metadata including control information of the object sound. The metadata determination unit 430 may determine metadata to be used for rendering among the plurality of metadata based on layout information of a speaker system included in audio reproduction environment information.

The rendering unit 440 may render the object sound and the background sound based on the metadata determined by the metadata determination unit 430. The rendering unit 440 may generate a target channel signal using the background sound, the object sound, and the metadata. The rendering unit 440 may generate the target channel signal by rendering the object sound controlled using the metadata to an audio scene including the background sound. The rendering unit 440 may form the audio scene in various channel environments using the background sound, the object sound, and the metadata.

Figure 5:
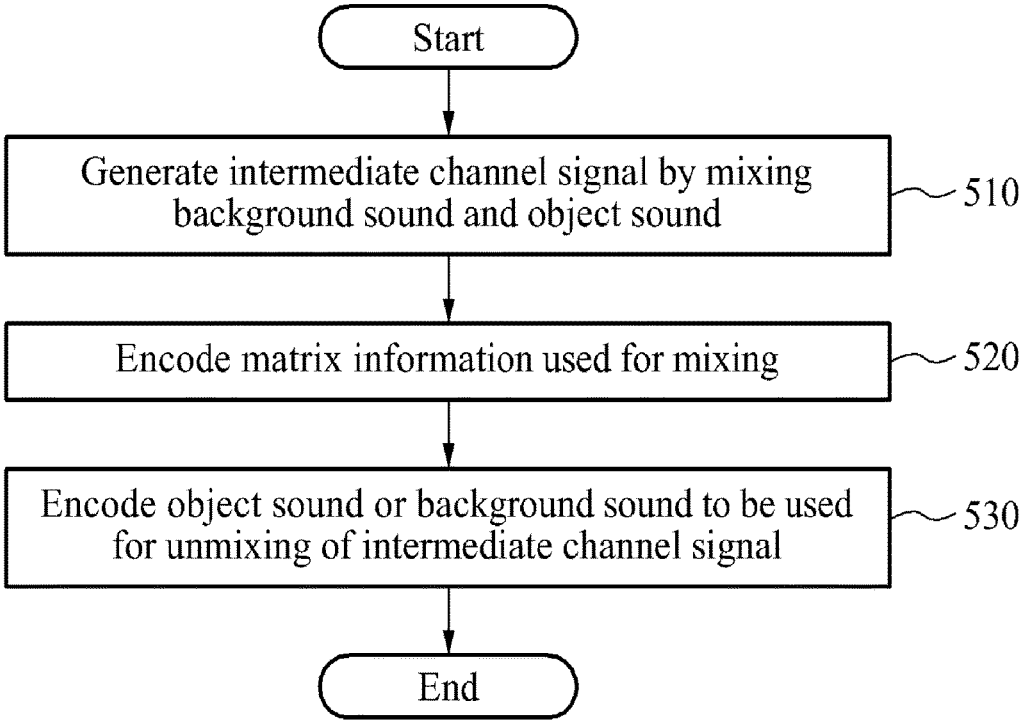
FIG. 5 is a flowchart illustrating an operation of an audio encoding apparatus, according to an embodiment of the present invention.

FIG. 5 is a flowchart illustrating an operation of an audio encoding apparatus, according to an embodiment of the present invention.

In operation 510, the audio encoding apparatus may generate an intermediate channel signal by mixing a background sound and an object sound. The audio encoding apparatus may perform mixing using matrix information for mixing of the background sound and the object sound. The audio encoding apparatus may perform mixing using a rendering matrix with respect to a vector element of the background sound and a rendering matrix with respect to a vector element of the object sound. The intermediate channel signal output by a mixing unit may be determined on the basis of the vector element of the background sound, the vector element of the object sound, a channel gain of the background sound, and a gain of the object sound mixed with the background sound.

In operation 520, the audio encoding apparatus may encode the matrix information used for mixing. According to an embodiment, operation 520 may be performed prior to operation 510 or simultaneously with operation 510.

In operation 530, the audio encoding apparatus may encode the intermediate channel signal and metadata including control information of the object sound, and encode the object sound or the background sound to be used for unmixing of the intermediate channel signal. The audio encoding apparatus may encode a plurality of metadata generated based on various reproduction environments.

Figure 6:
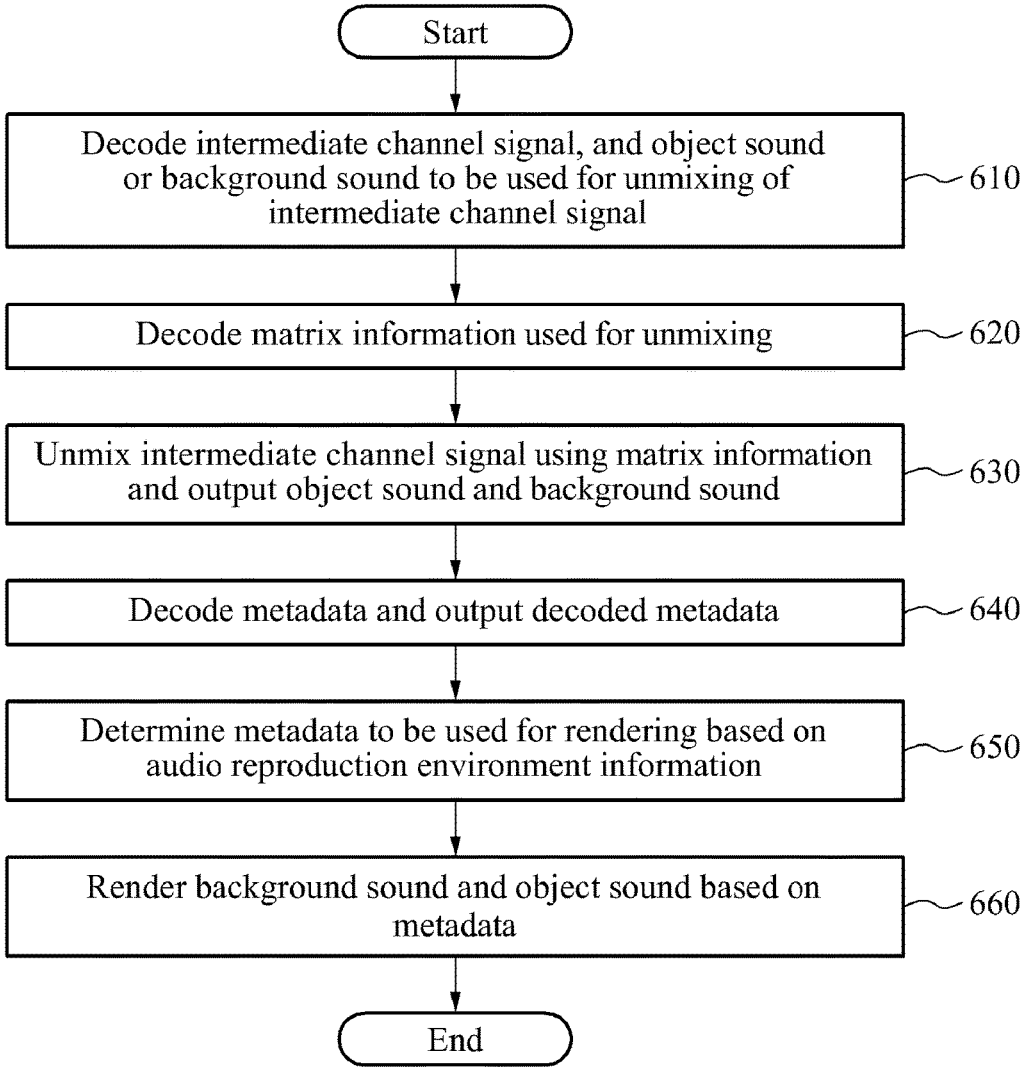
FIG. 6 is a flowchart illustrating an operation of an audio decoding apparatus, according to an embodiment of the present invention.

FIG. 6 is a flowchart illustrating an operation of an audio decoding method, according to an embodiment of the present invention.

In operation 610, an audio reproducing apparatus may decode an intermediate channel signal included in a bitstream, and an object sound or a background sound to be used for unmixing of the intermediate channel signal.

In operation 620, the audio reproducing apparatus may decode matrix information used for unmixing of the intermediate channel signal. Operation 620 may be performed prior to operation 610 or simultaneously with operation 610.

In operation 630, the audio reproducing apparatus may unmix the intermediate channel signal using the matrix information and output the object sound and the background sound. The audio reproducing apparatus may use the decoded object sound or the decoded background sound for the unmixing. For example, the audio reproducing apparatus may extract the background sound from the intermediate channel signal using the decoded object sound, and output the decoded object sound and the extracted background sound. As another example, the audio reproducing apparatus may extract the object sound from the intermediate channel signal using the decoded background sound and output the decoded background sound and the extracted object sound.

In operation 640, the audio reproducing apparatus may decode metadata including control information of the object sound, and output the decoded metadata. As a result of metadata decoding, a plurality of metadata may be reconstructed.

In operation 650, the audio reproducing apparatus may determine metadata to be used for rendering based on audio reproduction environment information. The audio reproducing apparatus may determine the metadata to be used for rendering, based on the audio reproduction environment information among the plurality of decoded metadata.

In operation 660, the audio reproducing apparatus may render the background sound and the object sound based on the determined metadata. The audio reproducing apparatus may output a target channel signal expressing an audio scene, by rendering the object sound and the background sound.

The above-described embodiments of the present invention may be recorded in non-transitory computer-readable media including program instructions to implement various operations embodied by a computer. The media may also include, alone or in combination with the program instructions, data files, data structures, and the like. The program instructions recorded on the media may be those specially designed and constructed for the purposes of the embodiments, or they may be of the kind well-known and available to those having skill in the computer software arts. Examples of non-transitory computer-readable media include magnetic media such as hard disks, floppy disks, and magnetic tape; optical media such as CD ROM disks and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments of the present invention, or vice versa.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. An audio decoding method performed by a processor, comprising:

decoding an encoded intermediate channel signal included in a bitstream;

decoding matrix information for the unmixing of the decoded intermediate channel signal;

unmixing the decoded intermediate channel signal using the matrix information and outputs an object sound and a background sound; and decoding metadata including control information of the object sound and outputs the decoded metadata, wherein the encoded intermediate signal is obtained by encoding an intermediate channel signal using an encoder, wherein the number of channels of the decoded intermediate channel signal is same as the number of channels of the background sound, wherein the object sound and the background sound are rendered using the metadata determined based on audio reproduction environment including a layout of a speaker system, and wherein the intermediate channel signal is determined based on a channel gain of the background sound, and a gain of the object sound mixed with the background sound.

2. The method of claim 1, wherein the object sound is a controllable audio and a dynamic audio scene associated with the background sound is formed based on the object sound.

3. The method of claim 1, wherein the intermediate channel is unmixed by using the object sound to output the background sound and the object sound or wherein the intermediate channel is unmixed by using the background sound to output the object sound and the background sound.

4. The method of claim 1, further comprising:

rendering the background sound and the object sound based on the metadata based on audio reproduction environment information.

5. An audio decoding method performed by a processor, comprising:

decoding an encoded intermediate channel signal related to a layout of a speaker system, and a metadata, extracting a background sound, an object sound from the decoded intermediate channel signal, rendering the object sound and the background sound based on the metadata, wherein the number of channels of the decoded intermediate channel signal is same as the number of channels of the background sound, wherein the encoded intermediate signal is obtained by encoding an intermediate channel signal using an encoder, wherein the object sound and the background sound are rendered using the metadata determined based on audio reproduction environment including a layout of a speaker system, and wherein the intermediate channel signal is determined based on a channel gain of the background sound, and a gain of the object sound mixed with the background sound.

6. The method of claim 5, wherein a layout of a speaker system is rendered using the metadata based on audio reproduction environments.

7. The method of claim 5, wherein the object sound is a controllable audio and a dynamic audio scene associated with the background sound is formed based on the object sound.

8. The method of claim 5, wherein a target channel signal is outputted for expressing an audio scene by rendering the object sound and the background sound.

* * * * *